US010249150B1

(12) United States Patent
Blower et al.

(10) Patent No.: US 10,249,150 B1
(45) Date of Patent: Apr. 2, 2019

(54) SECURITY APPARATUS FOR AN AUTOMATED TELLER MACHINE

(71) Applicant: International Business Machines Corporation, Armonk, NY (US)

(72) Inventors: Dave Blower, Greenford (GB); Simon James Forsdyke, Loughton (GB); Luke Tombs, San Ramon, CA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/723,584

(22) Filed: Oct. 3, 2017

(51) Int. Cl.
*G07F 19/00* (2006.01)

(52) U.S. Cl.
CPC ..... *G07F 19/207* (2013.01); *G07F 19/203* (2013.01); *G07F 19/209* (2013.01)

(58) Field of Classification Search
CPC ..... G07D 11/0018; G07D 11/0021; G07D 11/0036; G07D 11/0042; G07D 11/0048; G07D 11/0063; G07F 19/203; G07F 19/209; G07F 1/044
USPC ..... 235/379
See application file for complete search history.

(56) References Cited

U.S. PATENT DOCUMENTS

| | | | |
|---|---|---|---|
| 4,848,873 | A | 7/1989 | Villar |
| 5,721,420 | A | 2/1998 | May |
| 6,315,194 | B1 | 11/2001 | Graef et al. |
| 6,536,662 | B1 | 3/2003 | Ohno |
| 7,284,692 | B1 | 10/2007 | Douglass |
| 7,344,065 | B1 | 3/2008 | Graef |
| 7,494,053 | B1 | 2/2009 | Burns |
| 7,523,857 | B1 | 4/2009 | Graef |
| 7,780,083 | B2 | 8/2010 | Schliebe et al. |
| 9,666,035 | B2 * | 5/2017 | Blower ..... G07F 19/203 |

(Continued)

FOREIGN PATENT DOCUMENTS

| | | |
|---|---|---|
| CN | 1858811 | 11/2006 |
| CN | 100545877 | 9/2009 |

(Continued)

OTHER PUBLICATIONS

JP 3128253U, Toutsushi prevention device in the automated teller machine, 7 Pages, Jan. 11, 2007.

(Continued)

*Primary Examiner* — Seung H Lee
(74) *Attorney, Agent, or Firm* — Schmeiser, Olsen & Watts, LLP; Mark Vallone

(57) ABSTRACT

A cash capture operation defeating assembly for an automated teller machine and a method for detecting insertion of a cash capture device into the automated teller machine. The assembly includes a first sensor, a second sensor, and control circuitry for receiving object detection signals from the first and second sensors. When the first sensor detects a first object: (i) if the second sensor previously detected a second object within a predetermined time period before the first object was detected, then the control circuitry determines that a normal paper currency dispense has occurred and that the first and second objects each comprise the paper currency; (ii) if the second sensor has not previously detected the second object within the predetermined time period before the first object was detected, then the control circuitry determines that the first object is potentially a cash capture device.

23 Claims, 9 Drawing Sheets

(56) References Cited

U.S. PATENT DOCUMENTS

| | | | | |
|---|---|---|---|---|
| 9,984,538 | B2 * | 5/2018 | Crist | G07F 19/209 |
| 2004/0141059 | A1 * | 7/2004 | Enright | G06Q 20/18 348/150 |
| 2005/0173659 | A1 | 8/2005 | Jespersen et al. | |
| 2005/0269345 | A1 | 12/2005 | Sommerville | |
| 2005/0284925 | A1 | 12/2005 | Ahn et al. | |
| 2008/0136657 | A1 | 6/2008 | Clark et al. | |
| 2008/0142583 | A1 | 6/2008 | Yokoi et al. | |
| 2012/0160860 | A1 | 6/2012 | Milne et al. | |
| 2014/0151450 | A1 | 6/2014 | Lewis et al. | |
| 2015/0068863 | A1 | 3/2015 | Blower et al. | |
| 2017/0206731 | A1 | 7/2017 | Blower et al. | |

FOREIGN PATENT DOCUMENTS

| | | |
|---|---|---|
| CN | 101030308 | 10/2010 |
| CN | 101881840 | 11/2010 |
| CN | 102842014 | 12/2012 |
| DE | 102009003685 | 9/2010 |
| EP | 0965960 | 12/1999 |
| EP | 2648168 | 9/2013 |
| GB | 2414104 | 3/2006 |
| JP | H09134463 | 5/1997 |
| JP | H09185749 | 7/1997 |
| JP | 92006313398 | 11/2006 |
| JP | 2010224737 | 10/2010 |
| WO | WO2006079769 | 3/2006 |
| WO | 2008043995 | 4/2008 |
| WO | 2008057057 | 5/2008 |

OTHER PUBLICATIONS

GB920130082JP1, JPO Office Action IDS, dated Feb. 13, 2018, 1 Page.
Money Pass, The Nation's fastest-growing surcharge-free network, 'Cash claw' fraud on the rise in London, Nov. 29, 2012, Retrieved from internet on Nov. 19, 2013, URL: http://www.atmmarketplace.com/article/204495/-Cash-claw-fraud-on-the-rise-in-London, 3 pages.
Cennox, The ASD-8 Anti-Skimming Device & Trial Proposal, Mar. 7, 2013, www.cennox.com, 7 pages.
Emma Reynolds, Mail Online, Beware the cash trap! Claw-like devices inserted into ATM slots can steal notes in latest hole-in-the-wall scam, Retrieved from Internet on Nov. 19, 2013, 6 pages.
The ASD-8 Anti-Skimming Device, retrieved from Internet: URL:https://www.sterlingbankservices.com/pdfs/SBS_ASD-8_Anti-Skimming-Device_v2.6.pdf, 15 pages.
Anti-Cash-Trapping Solutions, retrieved from Internet: URL: http://www.wincor-nixdorf.com/internet/cae/servlet/contentblob/1182982/publicationFile/89608/AntiCashTrapping_DataSheet_EN.pdf, 2 pages.
Analysis of Security Issues of ATM, retrieved from Internet: URL: http://shodhganga.inflibnet.ac.in/bitstream/10603/25038/8/chapter-4.pdf, 60 pages.
International Search Report—PCT (dated Oct. 22, 2014), Applicant's file Reference Gb130082, International Application No. PCT/IB2014/060429, 10 pages.
Office Action (dated Mar. 12, 2015) for U.S. Appl. No. 14/461,768, filed Aug. 18, 2014.
Amendment (dated Jun. 12, 2015) for U.S. Appl. No. 14/461,768, filed Aug. 18, 2014.
Office Action (dated Oct. 8, 2015) for U.S. Appl. No. 14/461,768, filed Aug. 18, 2014.
Amendment (dated Jan. 6, 2016) for U.S. Appl. No. 14/461,768, filed Aug. 18, 2014.
Final Office Action (dated May 4, 2016) for U.S. Appl. No. 14/461,168, filed Aug. 18, 2014.
Final Amendment (dated Jul. 5, 2016) for U.S. Appl. No. 14/461,768, filed Aug. 18, 2014.
Advisory action (dated Jul. 4, 2016) for U.S. Appl. No. 14/461,768, filed Aug. 18, 2014.
RCE (Aug. 4, 2016) for U.S. Appl. No. 14/461,768, filed Aug. 18, 2014.
Office Action (dated Sep. 8, 2016) for U.S. Appl. No. 14/461,768, filed Aug. 18, 2014.
Amendment (dated Dec. 5, 2016) for U.S. Appl. No. 14/461,768, filed Aug. 18, 2014.
Notice of Allowance (dated Jan. 27, 2017) for U.S. Appl. No. 14/461,768, filed Aug. 18, 2014.
Patent application for U.S. Appl. No. 15/623,868, filed Jun. 15, 2017.
Reply to UK examination report, Application No. GB1611909.1, 2 pages, dated Jun. 1, 2017.
Combined Search and Examination Report, Application No. GB1611909.1, dated Jan. 23, 2017, 6 pages.
"Motorised Shutter Control—Chapter 12.3" source and author unknown. See Functional Descdption, 12.3-1 to 12.3-3 iri patiicular. Dated Mar. 2000. URL: http://leoromo.net/docs/cajero/personas/rnotmised%2Oshutter%20contro.pdf, 28 pages.
RCE (Oct. 2, 2017) U.S. Appl. No. 15/475,333, filed Mar. 31, 2017.
Notice of Allowance (dated Jul. 6, 2017) U.S. Appl. No. 15/475,333, filed Mar. 31, 2017.
U.S. Appl. No. 15/723,331, filed Oct. 3, 2017.

* cited by examiner

*Figure 1* (Prior Art)

*Figure 3* (Prior Art)
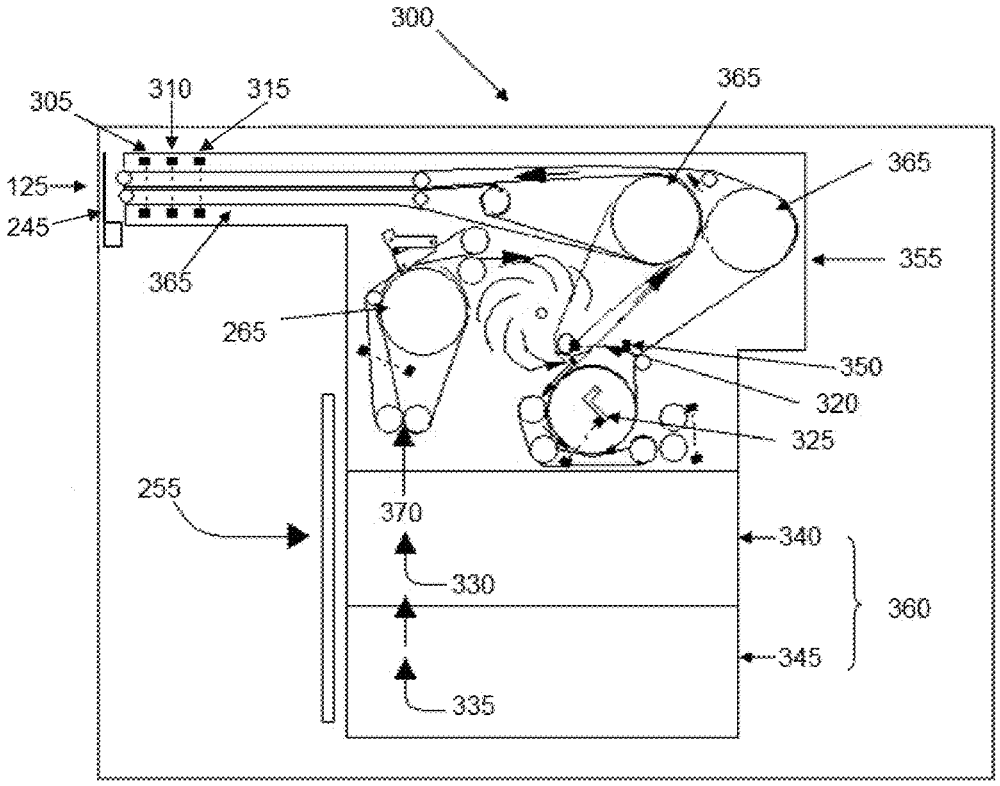

*Figure 5* (Prior Art)
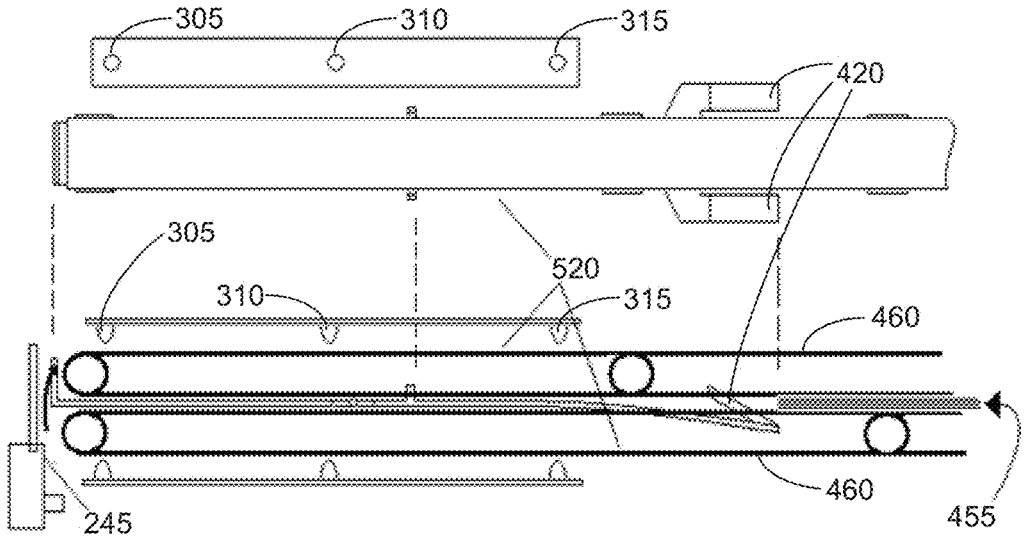
*Figure 6* (Prior Art)
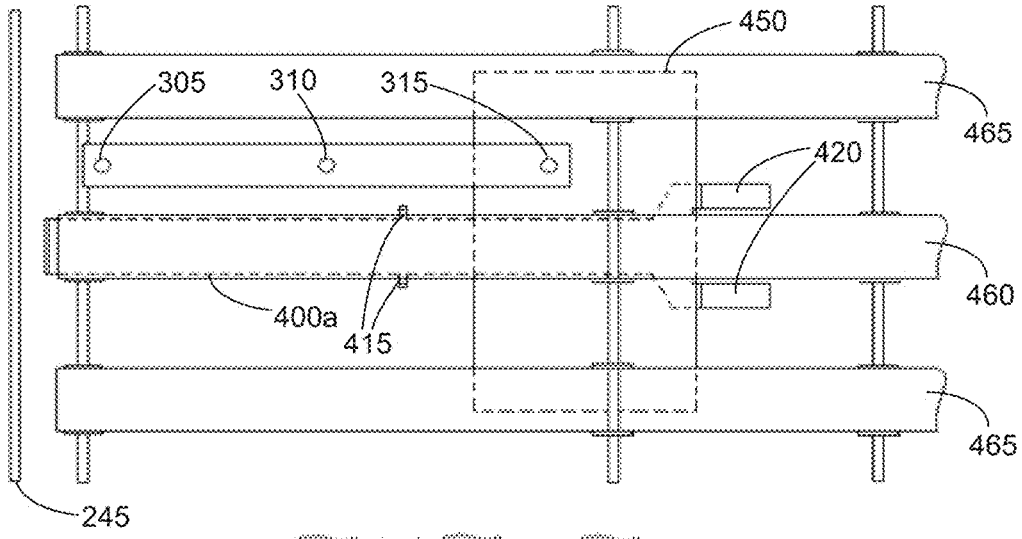
*Figure 7*
(Prior Art)
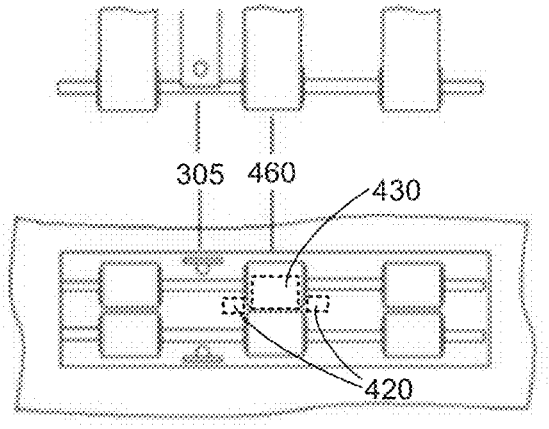

SECURITY APPARATUS FOR AN AUTOMATED TELLER MACHINE

TECHNICAL FIELD

The present invention relates to automated teller machines, and in particular a security apparatus for the detection and nullifying of the operation of a cash capture device inserted into a presenter area of an automated teller machine.

BACKGROUND

Automated banking machines are well known. A common type of automated banking machine used by consumers is an automated teller machine ("ATM"), colloquially known by terms such as "cash dispenser", "cash machine" or "hole-in-the-wall". ATMs enable customers to carry out banking transactions. Common banking transactions that may be carried out with ATMs include the dispensing of cash in the form of paper currency, the receipt of deposits, the transfer of funds between accounts, the payment of bills, account balance inquiries and mobile phone top-up etc. The types of banking transactions a customer can carry out are determined by capabilities of the particular banking machine and the institution offering the service.

In the United Kingdom there are around seventy thousand ATMs and this number is on the increase. ATM fraud is also on the increase and perpetrators are constantly devising new ways in which to fraudulently extract cash from inside ATMs. One method in which perpetrators attempt to extract cash from an ATM is by using a cash capture device. A cash capture device is inserted by the perpetrator in to a cash dispensing slot such that the cash is intercepted by the cash capture device inside the ATM and not dispensed to a user who has requested the cash. The perpetrator then returns to the ATM to remove the cash that is retained inside the ATM.

ATM fraud appears to be on the increase because ATM fraud produces cash and is fairly low risk relative to other crimes. The equipment used to implement ATM fraud is inexpensive, readily available and expendable, which makes ATM fraud popular with organized crime networks. There is therefore a need to provide an improved apparatus for cash capture device detection.

SUMMARY

Embodiments of the present invention provide a cash capture operation defeating assembly for an automated teller machine. A first sensor is mounted outside a plane of paper currency dispense and between a currency dispenser shutter and presenter belts of a presenter area of the automated teller machine and mounted in a same vertical plane as a pair of presenter belts, the first sensor being operable for detecting a first object inserted between presenter belts of a pair of presenter belts; and a second sensor mounted outside the plane of paper currency dispense in the presenter area and not mounted in the same vertical plane as the pair of presenter belts, the second sensor being operable for detecting paper currency as the paper currency passes in a paper currency dispense operation. Control circuitry is provided for receiving object detection signals from the first and second sensors. The assembly is operable in such a way that, when the first and second sensors are mounted in the automated teller machine and the first sensor detects an object: if the second sensor has previously detected a second object within a predetermined time period before the detecting of the first object by the first sensor, the time period being determined so as to encompass the time for traverse of paper currency from the second to the first sensor during a paper currency dispense operation, then the control circuitry determines that a normal paper currency dispense has occurred and that the first and second objects each comprise the paper currency, and if the second sensor has not previously detected the second object within the predetermined time period before the detecting of the first object by the first sensor, then the control circuitry determines that the first object detected by the first sensor is potentially a cash capture device, and the control circuitry initiates an alarm state of the assembly.

Embodiments of the present invention provide a kit of parts including the cash capture operation defeating assembly, and an automated teller machine including the cash capture operation defeating assembly. Further embodiments include a method for detecting insertion of a cash capture device into a presenter area of an automated teller machine, and a computer program product for performing the method.

BRIEF DESCRIPTION OF THE DRAWINGS

Embodiments of the present invention will now be described by way of example only, with reference to the accompanying drawings.

FIG. 3 is a schematic diagram illustrating a side view cross section of an example of an automated teller machine cash dispenser as is known in the art.

FIGS. 5, 6 and 7 respectively illustrate side, top and front views of the presenter area of a known automated teller machine showing the position of a cash capture device inserted between presenter belts in position to capture paper currency.

DETAILED DESCRIPTION

Figure 1:
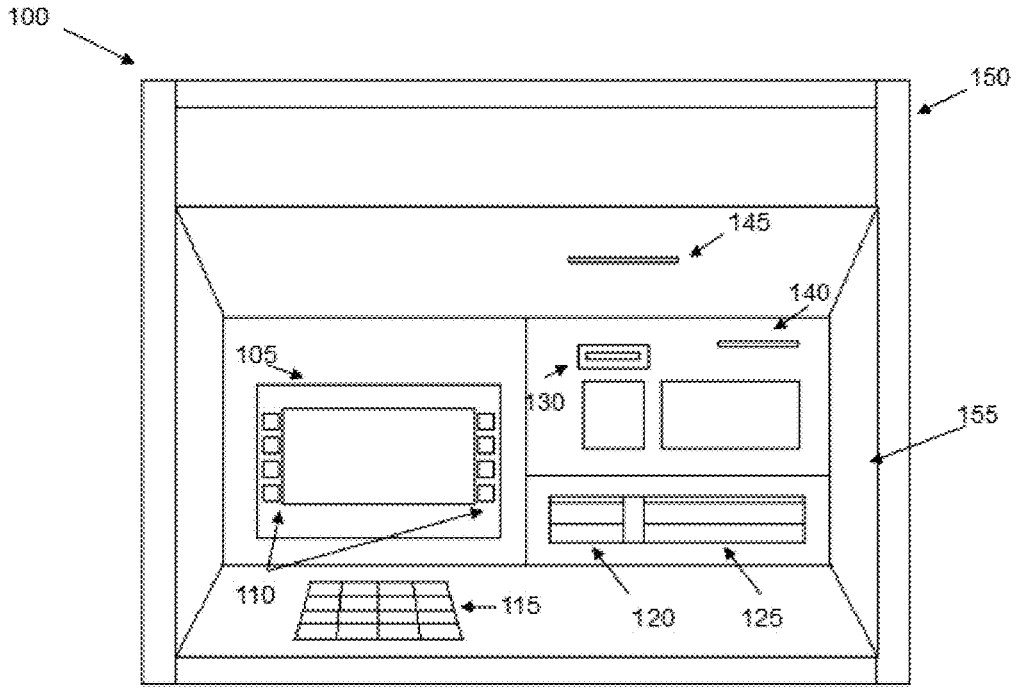
FIG. 1 is an illustration of an outer public face of an automated teller machine (ATM) as is known in the art.

It should be understood that the accompanying drawings are merely schematic and are not drawn to scale. It should also be understood that the same reference numerals are used throughout the description and the drawings to indicate the same or similar parts. Where reference is made to descriptors relating to orientation, such descriptors are used merely for the purposes of clarity and ease of understanding with reference to the drawings. They are not intended to limit the scope of the present invention. Embodiments of the present invention may be orientated in any way convenient without departing from the scope of the present invention.

Figure 2:
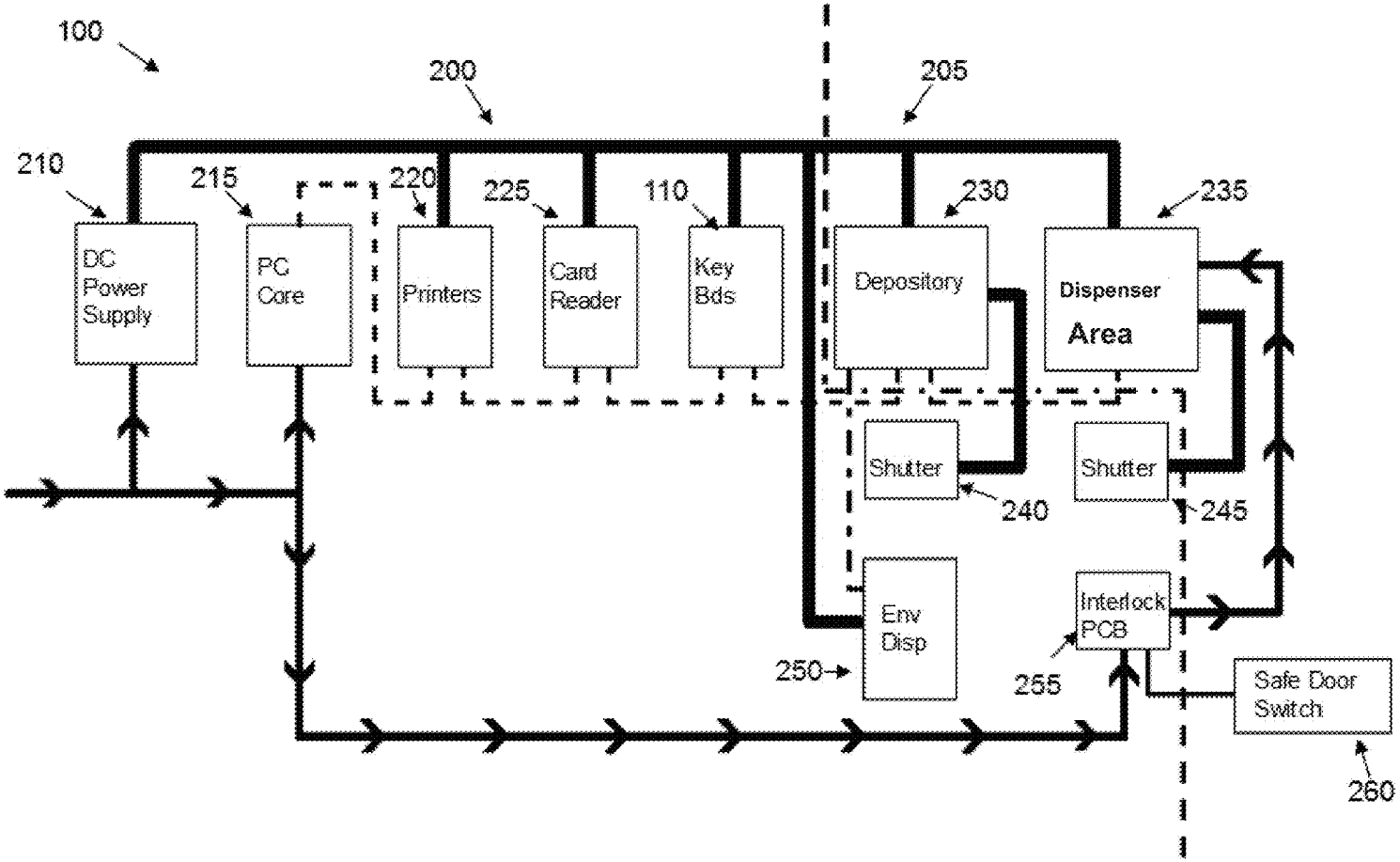
Figure 2 (Prior Art)
FIG. 2 is a block diagram illustrating an example of the internal components of the automated teller machine of FIG. 1 as is known in the art.

FIG. 1 is an illustration of an outer public face of an automated teller machine (ATM) 100 as is known in the art and FIG. 2 is a block diagram illustrating an example of the internal components of the automated teller machine 100 of FIG. 1 as is known in the art. FIG. 1 and FIG. 2 should be read in conjunction with each other.

The ATM 100 comprises a housing 150 which comprises a non-secure portion 200 and a secure portion 205.

The non-secure portion 200 comprises a further housing having a public outer fascia 155 which comprises a display 105 for displaying user information to a user, screen selection keys 110 and keypad 115 for inputting data, a DC power supply 210, a card reader 225 for receiving a user bank card or other form of identity via a card receiving aperture 130, a cash dispensing aperture 125 and associated shutter assembly 245 for dispensing cash in the form of paper currency processed and stored in a presenter area 235 of the ATM 100, a deposit aperture 120 for receiving deposits stored in a depository 230 and communicating with a deposit shutter assembly 240, an envelope dispensing aperture 145 for dispensing from envelope dispenser 250 envelopes for holding cash or check deposits for receiving by the deposit aperture 120, a receipt dispensing aperture 140 for dispensing receipts acknowledging a transaction made by a customer, an interlock PCB 255 coupled to a safe door switch 260, and a printer 220 for printing the receipts.

The non-secure portion 200 also houses a data processing apparatus 215 (which may include a PC core) for communicating with each of the components of the ATM 100 in order to process a requested transaction and to control the mechanical components of the ATM 100 in order to complete a requested and authorized transaction.

FIG. 3 is a schematic diagram illustrating a side view cross section of an example of an automated teller machine cash dispenser as is known in the art. FIG. 3 illustrates the secure portion 205 of FIG. 2 in further detail. The secure portion comprises a safe 300. The safe 300 comprises a housing having a first portion comprising a number of slideably mountable racks for mounting currency cassettes 340, 345 (collectively, 360) for storing paper currency. Paper currency is intended herein to mean UK banknotes, U.S.A dollar bills etc. The actual material of the banknotes may be other than paper, for example a polymer material. A second portion of the housing comprises one or more slideably mountable racks for mounting a presenter unit 355 comprising pick up modules 265 for singly picking-up one or more paper currency until the requested paper currency denomination is reached. The presenter unit 355 also comprises presenter belts 365 for transporting the requested paper currency from the currency cassettes 340, 345 along a transportation path 330, 335, 370 to the dispenser aperture 125. The second portion further comprises a slideably mountable reject tray (not shown) for holding reject paper currency detected by the data processing apparatus 215. The presenter unit 355 also comprises timing disk sensor arm 325 and drive belt 320.

Dispenser area 235 further comprises a number of optical sensors 305, 310, 315 for detecting and validating the presence of paper currency in the presenter area.

For clarity, the dispenser area 235 referred to herein comprises a presenter unit 355, the dispenser shutter assembly 245 and paper currency dispenser aperture 125. A person skilled in the art will realize that there are many types of internal configurations of an ATM 100 and the above description is not limiting. Many other configurations are possible without departing from the scope of the present invention.

In use a user inserts the user's bank card into the card reader 130 and the display unit 105 requests the user to enter their personal identification number. The data processing apparatus 215 validates the personal identification number and the display unit 105 presents the user with a number of financial transaction options. When a request for cash withdrawal is made and approved, the data processing apparatus 215 sends an instruction to the pickup module 265 which causes the pickup module 265 to obtain the requested paper currency from one or more of the currency cassettes 340, 345. As the individual units of paper currency are requested, the units of paper currency are validated and in response the presenter belts 365 transport the paper currency through the secure housing along a transportation path 330, 335 (following the direction of the arrows) for dispensing to the user through the currency dispenser aperture 125. In one embodiment, when the paper currency is transported along the transportation path, the paper currency passes under various sensors 350, 315, 310 and 305. The sensors perform various functions such as the following functions:

Sensor 350—acknowledges presence of paper currency after the measuring process.

Sensor 315—acknowledges timely arrival of paper currency for dispense.

Sensor 310—acknowledges timing restrictions and initiates a signal for the dispenser shutter to open.

Sensor 305—acknowledges a timing sequence and signals for dispenser shutter to close.

Once the paper currency is transported a predetermined distance from sensor 305 the cash dispenser shutter of shutter assembly 245 remains open until the user removes the paper currency from the cash dispenser aperture 125. Once the paper currency is removed by the user the cash dispenser shutter of shutter assembly 245 closes.

One method of fraudulent activity involving ATM machines is by use of a cash capture device. A fraud perpetrator inserts a cash capture device in to a cash dispensing aperture of the ATM. Cash requested by a subsequent user is retained in the ATM by the cash capture device and retrieved later by the perpetrator.

The most common type of cash capture device may also be termed a cash claw because of the shape of the device. Various designs of cash claw are known. Defensive measures are applied to ATMs to detect the presence of cash capture devices such as cash claws. Fraud perpetrators then devise new designs of cash claw to attempt to defeat these measures.

FIGS. 4*a*, 4*b*, 4*c* and 4*d* illustrate known designs of cash capture devices used in attempts to fraudulently obtain paper currency from an automated teller machine. Specifically, FIGS. 4*a* to 4*d* illustrate known designs of a cash claw.

Figure 4A:
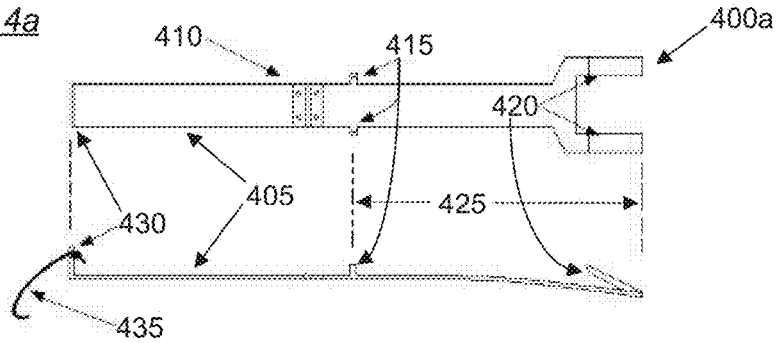
Figure 4a (Prior Art)
FIGS. 4*a*, 4*b*, 4*c* and 4*d* illustrate known designs of cash capture devices used in attempts to fraudulently obtain paper currency from an automated teller machine.

FIG. 4*a* illustrates a cash claw 400*a* which may be made of metal, but may comprise any suitable resilient material. Cash claw 400*a* comprises an arm 405 for inserting between one or more presenter belts 365. In one embodiment, the cash claw 400*a* may comprise a flexible portion 410 for facilitating manipulation of the cash claw 400*a* between the presenter belts 365. Flexible portion 410 may comprise a hinge. Cash claw 400*a* comprises at a distal end a claw 420 comprising one or more claw forks. The perpetrator inserts this distal end first into the cash aperture of the ATM. In one embodiment, the arm 405 of cash claw 400*a* may comprise a vertical portion 430 at a proximal end for hindering claw movement during a paper currency dispense operation and a wire 435 for easing removal by the perpetrator of claw 400*a*. Cash claw 400*a* comprises one or more stoppers 415 located at a medial point along the length of the arm 405. The one or more claw forks of claw 420 comprise end portions reversed in direction towards the proximal end of the claw. The one or more stoppers 415 and one or more claw forks of fork 420 are arranged so as to capture paper currency within a space 425 between the one or more stoppers 415 and the one or more claw forks of fork 420.

Figure 4B:
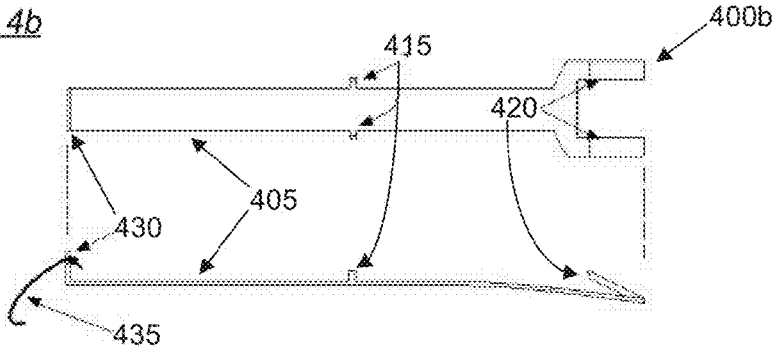
Figure 4b (Prior Art)

FIG. 4*b* illustrates a cash claw 400*b*, similar to 400*a* but without a medial hinge or flexible portion. Cash claw 400*b* is similar to cash claw 400*a* in shape and may comprise a plastics material of a more flexible nature than that of cash claw 400*a*, which obviates the need for the hinge. Plastics cash claws may be used to attempt to defeat ATM protection measures which depend on detection of an inserted metallic cash capture device. Cash claw 400*b* may comprise a transparent or translucent material such as a transparent or translucent plastics material. Transparent or translucent cash claws may be used to attempt to defeat ATM protection measures which depend on optical detection means.

Figure 4C:
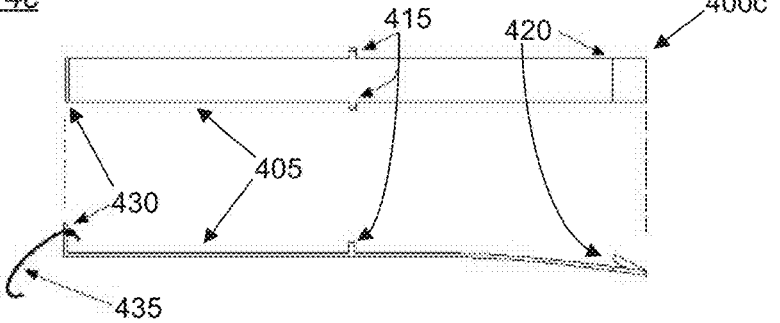
Figure 4c (Prior Art)

FIG. 4*c* illustrates a cash claw 400*c* having an in-line design where claw 420 does not extend laterally to claw forks so that in use does not extend beyond the edge of a presenter belt and thereby defeats physical blocking preventative measures. Cash claw 400*c* comprises stoppers 415.

Figure 4D:
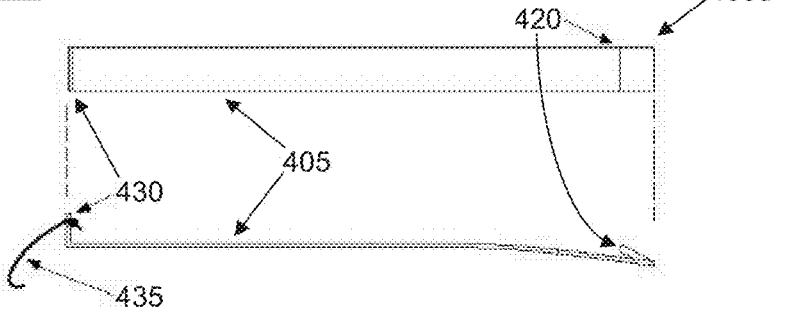
Figure 4d (Prior Art)

FIG. 4*d* illustrates a variant design 400*d* without the medial stoppers. This variant design requires the dispenser shutter to be jammed closed in order to function as a cash capture device.

FIGS. 5, 6 and 7 respectively illustrate side, top and front views of the presenter area of a known automated teller machine showing the position of a cash capture device inserted between presenter belts in position to capture paper currency. Specifically, FIGS. 5, 6 and 7 illustrate an example operation of a known fraudulent cash capture operation using a cash capture device such as a cash claw, various known designs of which are described with reference to FIGS. 4*a* to 4*d*.

A fraud perpetrator first gains access to the presenter area of the ATM behind the shutter. The perpetrator may do this by first requesting a low value cash amount from the ATM using, for example, a fraudulent prepaid bank cash card. When ATM shutter of shutter assembly 245 opens, the perpetrator inserts a cash capture device, for example cash claw 400*a*, between the center pair of presenter belts 460, for example, before removing the cash dispensed. Shutter of shutter assembly 245 closes with cash claw 400*a* in position as shown in FIG. 5. In another method, the perpetrator gains access by levering shutter of shutter assembly 245 open, inserting cash claw 400*a*, and then levering shutter of shutter assembly 245 closed. Cash claw 400*a*, with claw 420, stoppers 415, and vertical portion 430, is shown in position for the fraud in side view in FIG. 5, from above in FIG. 6, and from the front of the ATM in FIG. 7.

The perpetrator now waits for a subsequent user of the ATM to request a currency dispense. Paper currency passes from currency cassettes 340, 345, and arrives at point 455 between the presenter belts which extend closest to shutter assembly 245, identified here as center pair of belts 460 and outer pair of belts 465. The paper currency passes between the presenter belts for dispense. However, when the paper currency reaches the position of sensor 315, stoppers 415 prevent further travel and the paper currency does not reach sensor 310. ATM control circuitry of data processing apparatus 215 responds to the absence of a detection signal from sensor 310 to issue a "jam" message. Data processing apparatus 215 reverses pairs of presenter belts 460, 465 to attempt to rectify the jam. Attempted retraction of the paper currency fails as claw 420 arrests the paper currency to retain the paper currency in position 450 of FIG. 6. The ATM is now in a jam state and shutter of shutter assembly 245 remains closed. The requester of the cash assumes the machine has a fault and leaves. The perpetrator returns, levers shutter of shutter assembly 245 open and removes cash claw 400*a* with the retained paper currency.

Variations to the above process may occur. For example, when the perpetrator uses an in-line cash claw without stoppers, for example cash claw 400*d* of FIG. 4*d*, the shutter is jammed once the cash claw is inside.

Embodiments of the invention comprise a cash capture operation defeating assembly. The assembly comprises infrared sensors which can detect transparent or translucent objects, for example transparent or translucent plastics cash capture devices. The assembly also comprises associated control logic which may be embodied in electronic control circuitry. The assembly may comprise a cash capture defeating kit of parts which may be retrofitted to ATMs of appropriate types. Alternatively, an ATM may comprise the assembly incorporated into the design of the ATM and structurally part of the ATM control circuitry.

Figure 8:
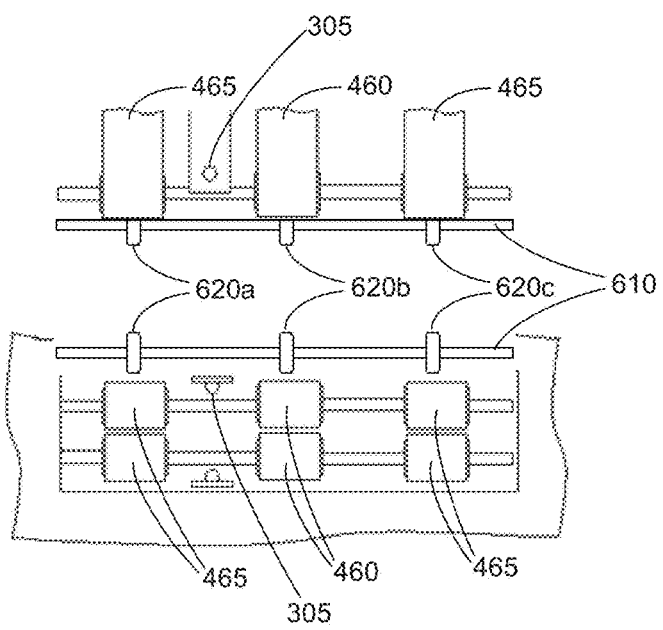
FIG. 8 illustrates front and top views of the region of the presenter area adjacent the dispenser shutter of an automated teller machine, in accordance with embodiments of the present invention.
Figure 9:
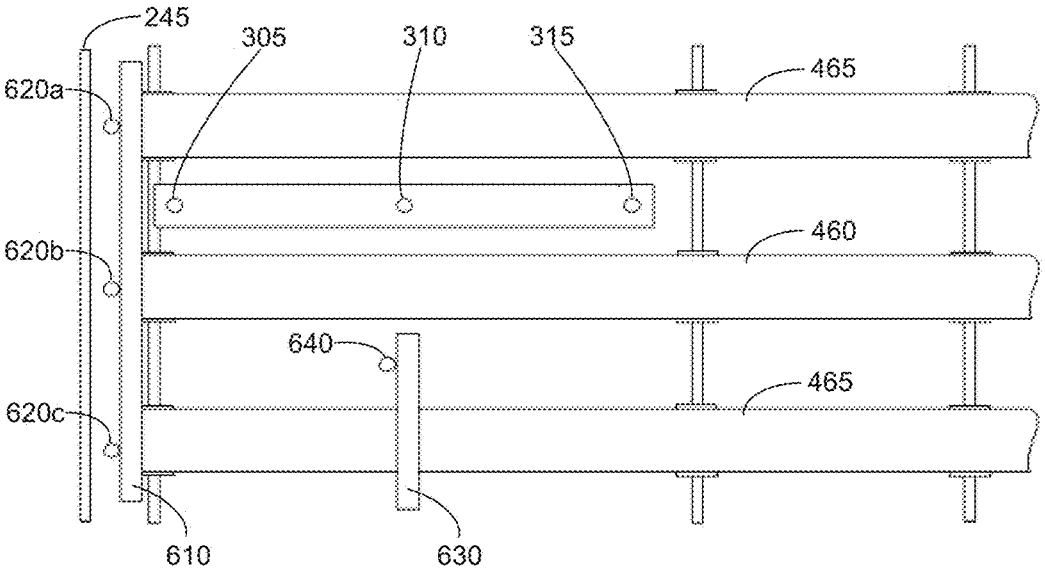
FIG. 9 illustrates a top view of the presenter area of an automated teller machine, in accordance with embodiments of the present invention.

FIG. 8 illustrates front and top views of the region of the presenter area adjacent the dispenser shutter assembly 245 of an automated teller machine, and FIG. 9 illustrates a top view of the presenter area of an automated teller machine, in accordance with embodiments of the present invention. The cash capture operation defeating assembly comprises a plurality of sensors operable to detect objects in the presenter area, preferably infrared sensors. The assembly comprises at least one infrared sensor mounted between the dispenser shutter assembly 245, and the ends of the presenter belts 460, 465 adjacent to dispenser shutter assembly 245. The sensors are mounted outside the plane of the paper currency dispense during ATM operation (i.e., above or below) so as to not impede currency dispensing. The at least one infrared sensor is in the same vertical plane as a pair of presenter belts; i.e., in line with the pair of presenter belts. In one embodiment, the assembly comprises a sensor mounted in the same vertical plane as each pair of presenter belts. In the arrangement illustrated, the presenter area comprises three pairs of presenter belts, central belts 460 and outer belts 465. In one embodiment, a mounting beam, rod or similar mounting member 610 provides a mounting point for the sensors and is suitably attached to an ATM structure of the ATM.

In one embodiment, the assembly comprises sensors 620*a*, 620*b*, and 620*c* positioned outside the plane of paper currency dispense, for example above the plane of paper currency dispense as illustrated in FIGS. 8 and 9, and attached to beam 610 and each in line with its respective belts 460, 465. The mounting member and sensors may be mounted below the plane of paper currency dispense without departing from the scope of the present invention. Infrared sensors 620*a*, 620*b* and 620*c* are operable for detecting objects inserted between their respective dispenser belts through the cash dispensing aperture of the ATM. Most cash capture operations involve inserting a cash capture device between central pair of presenter belts 460 and so a minimal arrangement comprising only sensor 620*b* at a single position suffices to provide detection only at the most likely insertion point. An embodiment comprising a single sensor 620*b* in this single position may be envisaged without departing from the scope of the present invention.

The assembly comprises at least one further infrared sensor 640 arranged within the presenter area occupied by the presenter belts which extend closest to shutter assembly 245. The infrared sensor 640 is therefore mounted further towards the interior of the ATM than sensors 620*a*, 620*b*, 620*c*. In one embodiment, a mounting beam, rod or similar mounting member 630 provides a mounting point for sensor 640 and is suitably attached to the ATM structure of the ATM. Sensor 640 is positioned outside the plane of paper currency dispense, i.e., above or below this plane of paper currency dispense, but, unlike sensors 620*a*, 620*b* and 620*c*, not in line with any of the presenter belts. Sensor 640 is therefore operable for detecting currency which is dispensed via the presenter area. Thus, the assembly may comprise more than one sensor 640 without departing from the scope of the present invention.

Infrared sensors 620*a*, 620*b*, 620*c* and 640 may comprise any suitable design operable for detecting objects by reception of reflected infrared radiation. One type of sensor which is readily available commercially comprises an infrared transmitter LED and an adjacent infrared receiver, which is operable for detecting an object by emitting from the transmitter infrared radiation which is reflected by an object in the path of the infrared radiation and the reflected infrared radiation is detected by the receiver which generates a detection signal.

In operation of the cash capture operation defeating assembly, sensors 620*a*, 620*b* and 620*c* serve to detect insertion of a cash capture device via the cash dispensing aperture when shutter of shutter assembly 245 is open. Sensor 640 serves to detect paper currency during a cash dispensing operation. The sensors may be termed device insertion sensors 620*a*, 620*b*, 620*c* and dispensed cash sensor 640 respectively.

The cash capture operation defeating assembly comprises, in addition to the sensors described with reference to FIGS. 8 and 9, electronic control circuitry connected by signal paths to the sensors; for example, sensors 620*a*, 620*b*, 620*c* and 640. The signal paths may comprise electrically conductive or fiber optic connections, or a short range wireless connection, for example.

Figure 10:
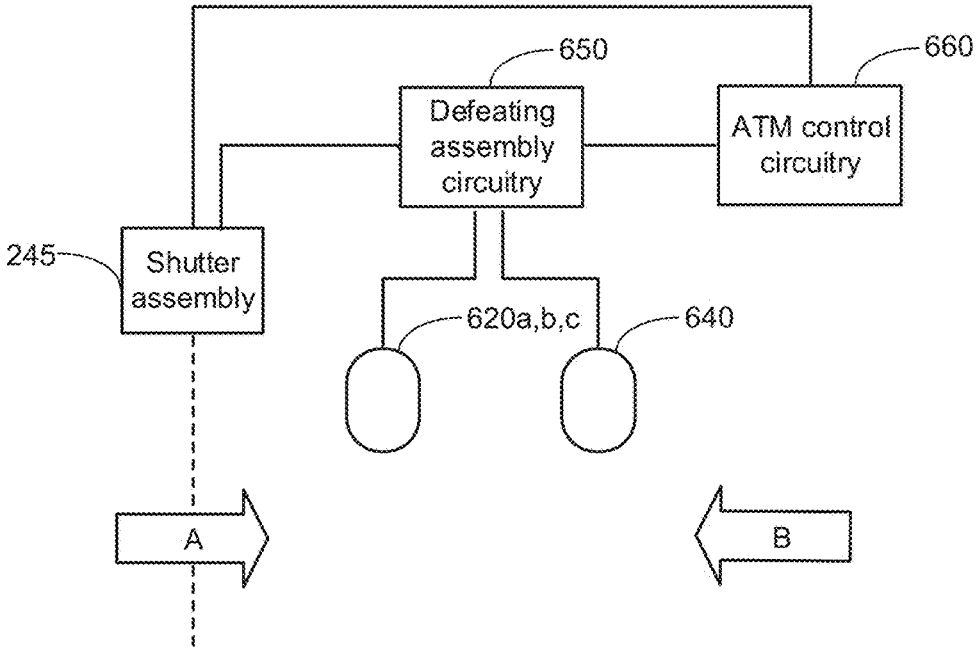
FIG. 10 is a schematic diagram illustrating a simplified structural diagram of a side view of embodiments of the present invention.

FIG. 10 is a schematic diagram illustrating a simplified structural diagram of a side view of embodiments of the present invention. In FIG. 10, device insertion sensors 620*a*, 620*b* and 620*c* of FIGS. 8 and 9 are represented for simplicity by a single sensor 620*a,b,c*. Sensor 620*a,b,c* serves to detect insertion of a cash capture device via cash dispensing opening exposed by opening of shutter of shutter assembly 245. Sensor 640 serves to detect dispensing of paper currency in a cash dispensing operation. Sensor 620*a,b,c* and sensor 640 are connected to cash capture operation defeating assembly control circuitry 650. In embodiments, cash capture operation defeating assembly control circuitry 650 is connected in turn with ATM control circuitry 660. Cash capture operation defeating assembly control circuitry 650 may comprise part of ATM control circuitry 660 where the design of the ATM for manufacture incorporates embodiments of the present invention. In other embodiments, cash capture operation defeating assembly control circuitry 650 is independent of ATM control circuitry 660 and communicates directly with relevant operating assemblies of the ATM, such as shutter assembly 245.

In operation of the assembly, device insertion sensor 620*a,b,c* and currency dispense sensor 640 operate in concert to detect insertion of a cash capture device. Sensor 640 generates a detection signal when sensor 640 detects an object (e.g., paper currency). If sensor 620*a,b,c* detects an object within a predetermined time period after sensor 640 detects an object, then a normal currency dispense operation is indicated and the object detected by sensor 620*a,b,c* is the paper currency previously detected by sensor 640. If sensor 620*a,b,c* detects an object without this prior object detection by sensor 640, then the object detected by sensor 620*a,b,c* is being fraudulently inserted into the presenter area.

Figure 11:
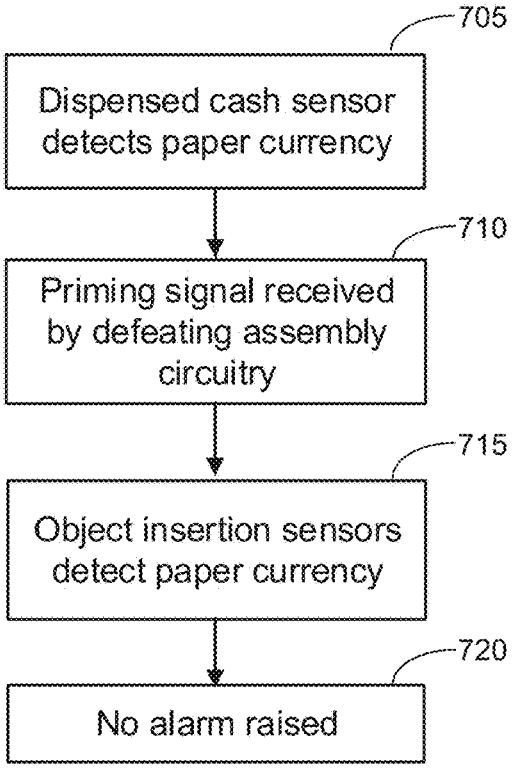
FIGS. 11 and 12 are flow diagrams illustrating operation of embodiments of the present invention.
Figure 12:
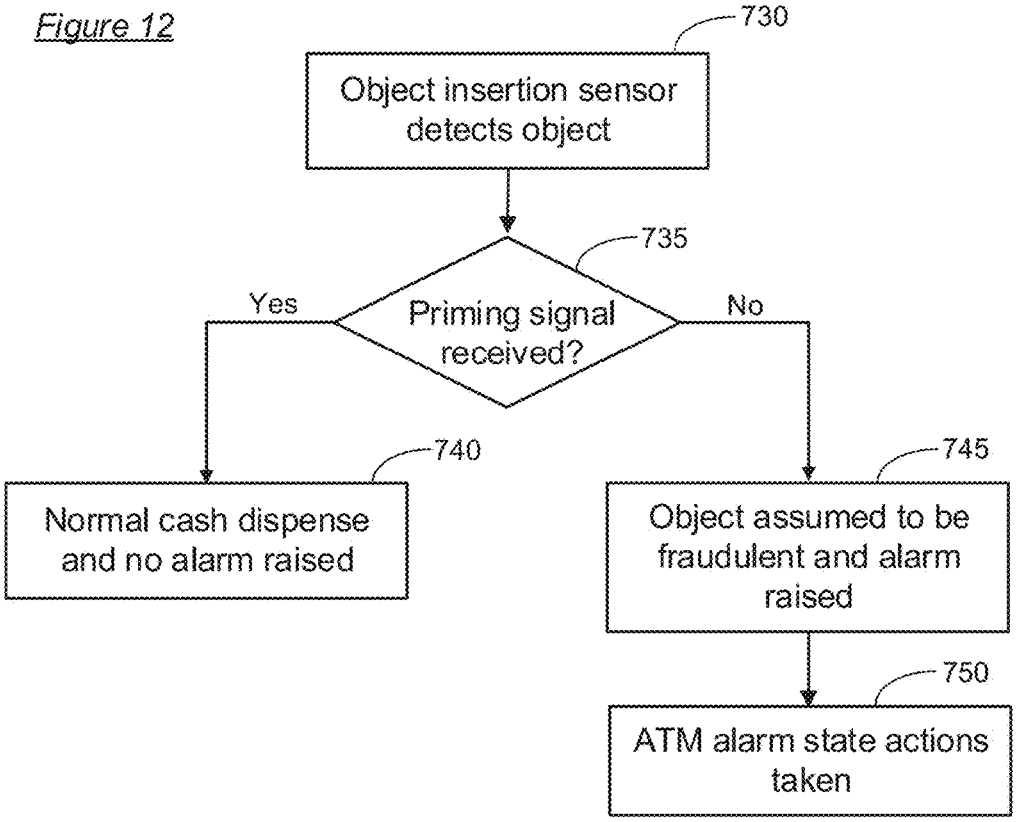

FIGS. 11 and 12 are flow diagrams illustrating operation of embodiments of the present invention. Operation of an embodiment of the invention will now be described with reference to FIGS. 10 and 11.

During a normal cash dispensing operation of the ATM, paper currency comprising a number of paper currency notes travels in direction of arrow B of FIG. 10. Dispensed cash sensor 640 detects at step 705 an object comprising paper currency. Sensor 640 communicates a detection signal to cash capture operation defeating assembly control circuitry 650. This detection signal may be termed a priming signal. Defeating assembly circuitry 650 receives this priming signal at step 710 and knows to expect the paper currency at sensors 620*a,b,c* within a predetermined time interval. The predetermined time interval encompasses the normal time of traverse of currency to the dispensing shutter 245. Object insertion sensors 620*a,b,c* detect at step 715 an object comprising paper currency travelling in direction of arrow B within this time interval, resulting at no alarm being raised at step 720. Defeating cash capture operation defeating assembly circuitry 650 does not raise an alarm because cash capture operation defeating assembly circuitry 650 has received the priming signal. ATM control circuitry 660 instructs shutter assembly 245 to open, and shutter assembly 245 opens to dispense the currency in the normal way.

FIG. 12 illustrates a decision flow for object detection by object insertion sensors 620*a,b,c*. At least one sensor of sensors 620*a,b,c* detects an object at step 730. The at least one sensor communicates a detection signal to cash capture operation defeating assembly control circuitry 650. Defeating assembly circuitry 650 determines at step 735 whether or not cash capture operation defeating assembly circuitry 650 has received a priming signal within the predetermined time interval which encompasses the normal time of traverse of currency to the dispensing shutter. If cash capture operation defeating assembly circuitry 650 has received an appropriate priming signal, the flow follows the "yes" branch and a normal currency dispense operation proceeds at step 740. If cash capture operation defeating assembly circuitry 650 has not received an appropriate priming signal, the flow follows the "no" branch. Cash capture operation defeating assembly control circuitry 650 determines at step 745 that the detected object is fraudulent; for example, an inserted cash capture device. Thus, cash capture operation defeating assembly circuitry 650 enters an alarm state. In some embodiments cash capture operation defeating assembly circuitry 650 may communicate an alarm signal to ATM control circuitry 660. Cash capture operation defeating control circuitry 650, and in some embodiments also ATM control circuitry 660, take alarm state actions at step 750.

Elements of an exemplary embodiment of the present invention in which the cash capture operation defeating assembly comprises a device insertion detection kit comprising an assembly of parts which may be applied to an existing ATM will now be described with reference to FIGS. 13, 14 and 15.

The assembly is denoted as an anti-cash trapping kit which may be applied to an existing ATM without requiring modification of existing ATM control circuitry and is illustrative of one way of implementing the present invention. Other embodiments may be implemented without departing from the scope of the present invention.

Figure 13:
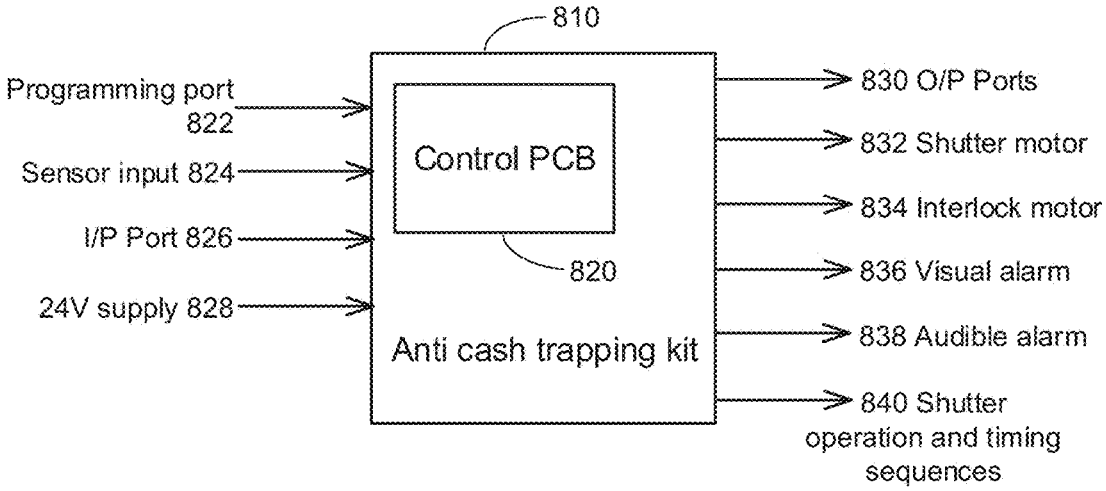
FIG. 13 is a schematic diagram of an anti-cash trapping kit, in accordance with embodiments of the present invention.

FIG. 13 is a schematic diagram of an anti-cash trapping kit 810, in accordance with embodiments of the present invention. As illustrated diagrammatically in FIG. 13, the anti-cash trapping kit 810 comprises a control printed circuit board (PCB) 820 comprising processing capacity. An operator may program the control PCB 820 by providing input via programming port 822. Information input via programming port 822 may include instructions teaching the kit when to expect paper currency and in which direction, and timing sequences and how to perform the instructions. Sensor input is via an interface input 824. A 24V supply connection 828 provides electrical power to the kit.

In the embodiment of FIG. 13, the kit has five input/output (I/O) ports. One I/O port is configured as an input, I/P port 826, and the remaining I/O ports as outputs, O/P ports 830. The input port, I/P port 826, may provide for expansion of the kit by, for example, networking connection. Outputs, O/P ports 830, may provide for one or more modular options, for example a strobe, a GSM dialler, digital recorded announcement equipment, etc. In the embodiment, the kit has a direct connection 832 to the shutter motor and is configured to drive the shutter motor. The kit also has a direct connection 834 to the dispenser interlock circuitry operable for disabling dispenser operation. The kit connects 838 to an adjustable audible alarm and 836 to a visual alarm comprising an LED array. The kit is operable to drive 840 shutter operations and timing sequences.

Figure 14:
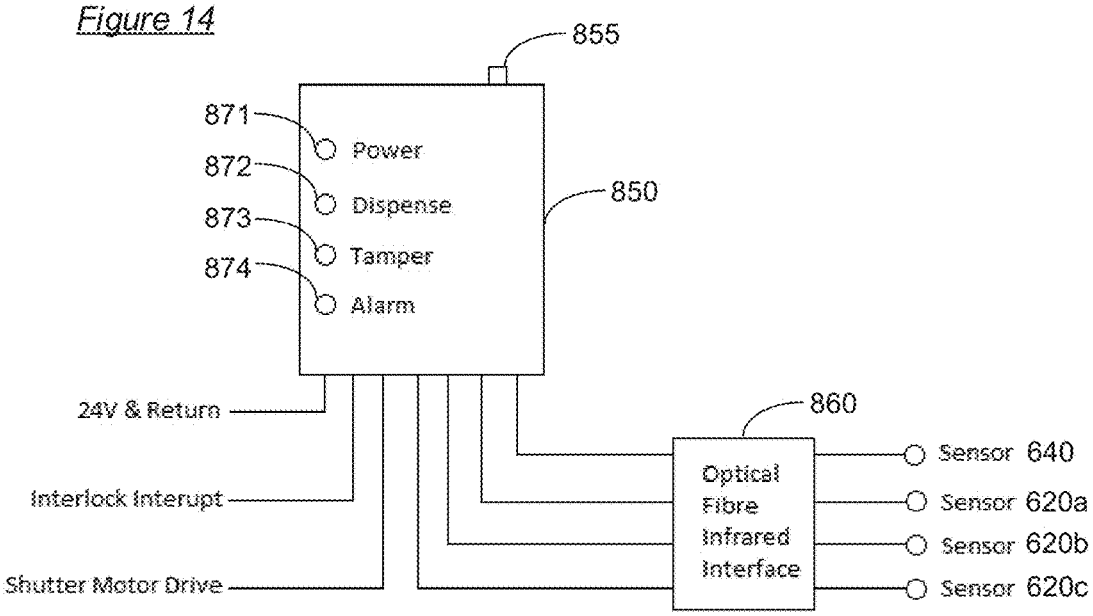
FIG. 14 is a diagram of component parts of the anti-cash trapping kit of FIG. 13, in accordance with embodiments of the present invention.

FIG. 14 is a diagram of component parts of the anti-cash trapping kit 810 of FIG. 13, in accordance with embodiments of the present invention. FIG. 14 illustrates a structural arrangement for the ant-cash trapping kit 810 in one embodiment. Plastic box housing 850 houses control PCB 820. Sensors 620*a,b,c* and 640 connect via an optical fiber infrared interface 860 to control PCB 820 in housing 850. Housing 850 comprises status indicators for power 871, dispense operation 872, tamper 873 and alarm 874. Housing 850 also comprises reset switch 855. If an ATM operator, for example a bank employee, finds an alarm state on the housing, the ATM operator may operate reset switch 855 which causes dispenser shutter of shutter assembly 245 to open so that the operator may remove the cash capture device. Shutter of shutter assembly 245 closes automatically after removal of the cash capture device. The ATM operator may then perform a dispenser test operation to resolve the ATM fault state.

Figure 15:
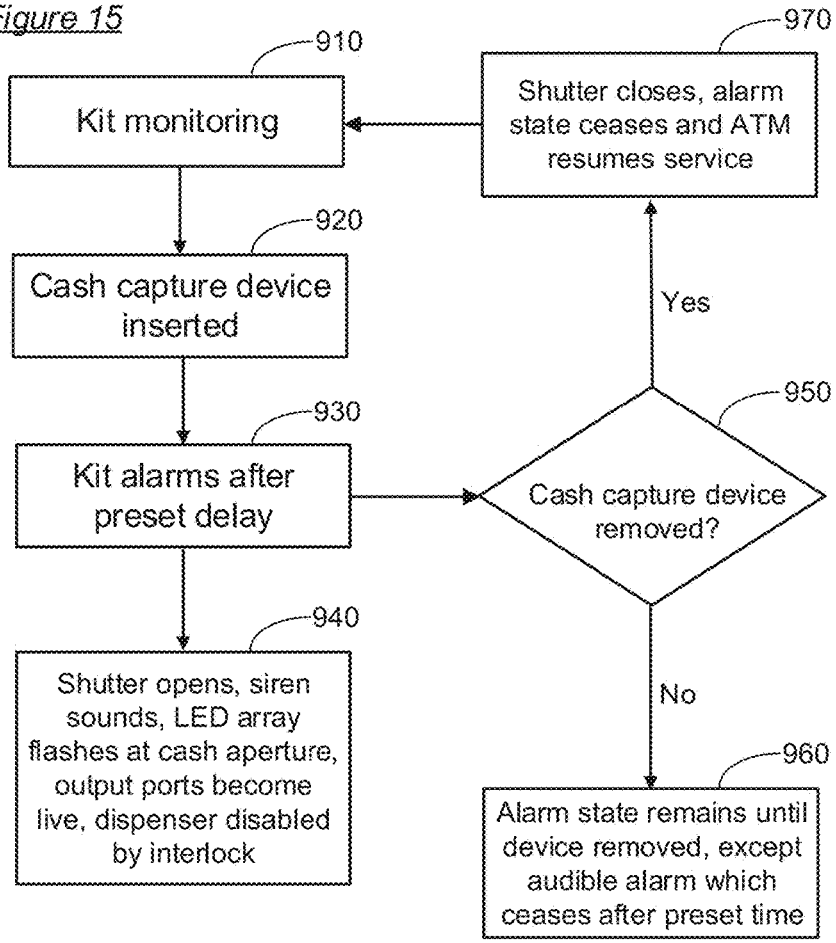
FIG. 15 is a flow diagram illustrating operation of embodiments of the present invention.

FIG. 15 is a flow diagram illustrating operation of embodiments of the present invention. FIG. 15 illustrates operation of the anti-cash trapping kit 810 according to the embodiment described with reference to FIGS. 13 and 14. In normal operation in an ATM, anti-cash trapping kit 810 is in monitoring mode, at step 910. A perpetrator inserts a cash capture device into the presenter area at step 920. One sensor of sensors 620*a*, 620*b*, 620*c* detects the cash capture device and, after the predetermined time delay has elapsed as described above, the kit enters the alarm state at step 930. Actions taken by the kit in this alarm state are shown at step 940 and may comprise one, more than one, or all of the following: shutter opening to reveal the device; audible alarm siren sounding; the LED array at the cash aperture flashing; output ports becoming live so that any additional modules attached to these ports is activated; and the interlock circuit being made open circuit to protect the presenter from damage. A decision step 950 asks if the cash capture device has been removed. If"yes", at step 970 the kit drives the ATM cash dispenser shutter of shutter assembly 245 closed, ceases the alarm state, the kit resumes monitoring, and the ATM remains in service and capable of normal operation. If "no", so that the cash capture device remains in the presenter, at step 960 the alarm state remains. The audible alarm may cease after a set time, but the visual alarm remains active, the output ports remain active, and the interlock remains open circuit until the cash capture device is removed.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

A computer program product of the present invention comprises one or more computer readable hardware storage devices having computer readable program code stored therein, said program code executable by control circuitry of a cash capture operation defeating assembly to implement the methods of the present invention (e.g., a method for detecting insertion of a cash capture device into the presenter area of an automated teller machine).

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others or ordinary skill in the art to understand the embodiments disclosed herein.

What is claimed is:

1. A cash capture operation defeating assembly for an automated teller machine, said assembly comprising:

a first sensor mounted outside a plane of paper currency dispense and between a currency dispenser shutter and presenter belts of a presenter area of the automated teller machine and mounted in a same vertical plane as a pair of presenter belts, said first sensor being operable for detecting a first object inserted between presenter belts of a pair of presenter belts;

a second sensor mounted outside the plane of paper currency dispense in the presenter area and not mounted in the same vertical plane as the pair of presenter belts, said second sensor being operable for detecting paper currency as the paper currency passes in a paper currency dispense operation; and control circuitry for receiving object detection signals from the first and second sensors; said assembly operable in such a way that, when the first and second sensors are mounted in the automated teller machine and the first sensor detects a first object:

if the second sensor has previously detected a second object within a predetermined time period before the detecting of the first object by the first sensor, the time period being determined so as to encompass the time for traverse of paper currency from the second to the first sensor during a paper currency dispense operation, then the control circuitry determines that a normal paper currency dispense has occurred and that the first and second objects each comprise the paper currency; and if the second sensor has not previously detected the second object within the predetermined time period before the detecting of the first object by the first sensor, then the control circuitry determines that the first object detected by the first sensor is a cash capture device, and the control circuitry initiates an alarm state of the assembly.

2. The cash capture operation defeating assembly of claim 1, wherein the first and second sensors comprise infrared sensors.

3. The cash capture operation defeating assembly of claim 1, wherein the first sensor is mounted in the same vertical plane as the center pair of presenter belts of the presenter area.

4. The cash capture operation defeating assembly of claim 3, wherein an additional first sensor is mounted in the same vertical plane as each other pair of presenter belts of the presenter area between a cash dispenser shutter and the presenter belts of a presenter and operable for detecting an object inserted between their respective pair of presenter belts.

5. The cash capture operation defeating assembly of claim 1, wherein the control circuitry comprises outputs for sending control signals to, and inputs for receiving signals from, components of an automated teller machine when installed on the automated teller machine.

6. The cash capture operation defeating assembly of claim 1, wherein the automated teller machine control circuitry comprises the control circuitry for receiving object detection signals from the first and second sensors.

7. A cash capture operation defeating assembly for an automated teller machine, said assembly comprising a kit of parts comprising:

a first part comprising a first sensor for mounting outside a plane of paper currency dispense and between a currency dispenser shutter and presenter belts of a presenter area of the automated teller machine and for mounting in a same vertical plane as a pair of presenter belts, said first sensor being operable for detecting a first object inserted between presenter belts of a pair of presenter belts;

a second part comprising a second sensor for mounting outside the plane of paper currency dispense in the presenter area and not for mounting in the same vertical plane as the pair of presenter belts, said second sensor being operable for detecting paper currency as the paper currency passes in a paper currency dispense operation; and a third part comprising control circuitry for receiving object detection signals from the first and second sensors so that when the kit of parts is installed on an automated teller machine, the assembly is operable in such a way that, when the first sensor detects a first object:

if the second sensor has previously detected a second object within a predetermined time period before the detecting of the first object by the first sensor, the time period being determined so as to encompass the time for traverse of paper currency from the second to the first sensor during a paper currency dispense operation, then the control circuitry determines that a normal paper currency dispense has occurred and that the first and second objects each comprise the paper currency; and if the second sensor has not previously detected the second object within the predetermined time period before the detecting of the first object by the first sensor, then the control circuitry determines that the first object detected by the first sensor is a cash capture device, and the control circuitry initiates an alarm state of the assembly.

8. The cash capture operation defeating assembly of claim 7, wherein the first and second sensors comprise infrared sensors.

9. The cash capture operation defeating assembly of claim 7, wherein the first sensor is for mounting in the same vertical plane as the center pair of presenter belts of the presenter area.

10. The cash capture operation defeating assembly of claim 9, wherein the kit comprises one or more additional parts, an additional part comprising an additional first sensor for mounting in the same vertical plane as one other pair of presenter belts of the presenter area between a cash dispenser shutter and the presenter belts of a presenter.

11. The cash capture operation defeating assembly of claim 7, wherein the control circuitry comprises outputs for sending control signals to, and inputs for receiving signals from, components of an automated teller machine when installed on the automated teller machine.

12. The cash capture operation defeating assembly of claim 7, wherein the third part comprises a housing for the control circuitry.

13. An automated teller machine, comprising a cash capture operation defeating assembly, said assembly comprising:

a first sensor positioned outside a plane of paper currency dispense and between a currency dispenser shutter and presenter belts of a presenter area of the automated teller machine and mounted in a same vertical plane as a pair of presenter belts, said first sensor being operable for detecting a first object inserted between presenter belts of a pair of presenter belts;

a second sensor positioned outside the plane of paper currency dispense in the presenter area and not mounted in the same vertical plane as the pair of presenter belts, said second sensor being operable for detecting paper currency as the paper currency passes in a paper currency dispense operation; and control circuitry for receiving object detection signals from the first and second sensors; said assembly operable in such a way that, when the first sensor detects a first object:

if the second sensor has previously detected a second object within a predetermined time period before the detecting of the first object by the first sensor, the time period being determined so as to encompass the time for traverse of paper currency from the second to the first sensor during a paper currency dispense operation, then the control circuitry determines that a normal paper currency dispense has occurred and that the first and second objects each comprise the paper currency; and if the second sensor has not previously detected the second object within the predetermined time period before the detecting of the first object by the first sensor, then the control circuitry determines that the first object detected by the first sensor is a cash capture device, and the control circuitry initiates an alarm state of the assembly.

14. The cash capture operation defeating assembly of claim 13, wherein the first and second sensors comprise infrared sensors.

15. The automated teller machine of claim 13, wherein the first sensor is positioned in the same vertical plane as the central pair of presenter belts of the presenter area.

16. The automated teller machine of claim 15, wherein at least one additional first sensor is positioned in the same vertical plane as one other pair of presenter belts of the presenter area between a cash dispenser shutter and the presenter belts of a presenter.

17. The automated teller machine of claim 13, wherein the first sensor is mounted on a first mounting beam attached to an automated teller machine structure of the automated teller machine.

18. The automated teller machine of claim 13, wherein the second sensor is mounted on a second mounting beam attached to an automated teller machine structure automated teller machine.

19. The automated teller machine of claim 13, wherein the control circuitry comprises outputs for sending control signals to, and inputs for receiving signals from, components of the automated teller machine.

20. The automated teller machine of claim 13, wherein the automated teller machine control circuitry comprises the control circuitry for receiving object detection signals from the first and second sensors.

21. A method for detecting insertion of a cash capture device into a presenter area of an automated teller machine, said method comprising providing a cash capture operation defeating assembly, said assembly comprising:

a first sensor mounted outside a plane of paper currency dispense and between a currency dispenser shutter and presenter belts of a presenter area of the automated teller machine and mounted in a same vertical plane as a pair of presenter belts, said first sensor being operable for detecting a first object inserted between presenter belts of a pair of presenter belts;

a second sensor mounted outside the plane of paper currency dispense in the presenter area and not mounted in the same vertical plane as the pair of presenter belts, said second sensor being operable for detecting paper currency as the paper currency passes in a paper currency dispense operation; and control circuitry for receiving object detection signals from the first and second sensors and determining an outcome;

said method further comprising:

detecting a first object by the first sensor, and:

if the second sensor has previously detected a second object within a predetermined time period before the detecting of the first object by the first sensor, the time period being determined so as to encompass the time for traverse of paper currency from the second to the first sensor during a paper currency dispense operation, then the control circuitry determining that a normal paper currency dispense has occurred and that the first and second objects each comprise the paper currency; and if the second sensor has not previously detected the second object within the predetermined time period before the detecting of the first object by the first sensor, then the control circuitry determining that the first object detected by the first sensor is the cash capture device, and the control circuitry initiating an alarm state of the assembly.

22. The method of claim 21, said method further comprising:

providing the control circuitry with outputs for sending control signals to, and inputs for receiving signals from, components of the automated teller machine and controlling the components thereby by the control circuitry.

23. A computer program product comprising one or more computer readable hardware storage devices having computer readable program code stored therein, said program code executable by control circuitry of a cash capture operation defeating assembly to implement a method for detecting insertion of a cash capture device into a presenter area of an automated teller machine, said method comprising providing a cash capture operation defeating assembly, said assembly comprising:

a first sensor mounted outside a plane of paper currency dispense and between a currency dispenser shutter and presenter belts of a presenter area of the automated teller machine and mounted in a same vertical plane as a pair of presenter belts, said first sensor being operable for detecting a first object inserted between presenter belts of a pair of presenter belts;

a second sensor mounted outside the plane of paper currency dispense in the presenter area and not mounted in the same vertical plane as the pair of presenter belts, said second sensor being operable for detecting paper currency as the paper currency passes in a paper currency dispense operation; and control circuitry for receiving object detection signals from the first and second sensors and determining an outcome;

said method further comprising:

detecting a first object by the first sensor, and:

if the second sensor has previously detected a second object within a predetermined time period before the detecting of the first object by the first sensor, the time period being determined so as to encompass the time for traverse of paper currency from the second to the first sensor during a paper currency dispense operation, then the control circuitry determining that a normal paper currency dispense has occurred and that the first and second objects each comprise the paper currency; and if the second sensor has not previously detected the second object within the predetermined time period before the detecting of the first object by the first sensor, then the control circuitry determining that the first object detected by the first sensor is the cash capture device, and the control circuitry initiating an alarm state of the assembly.

* * * * *